US007610700B2

(12) United States Patent
Dean et al.

(10) Patent No.: US 7,610,700 B2
(45) Date of Patent: Nov. 3, 2009

(54) AUTOMATICALLY STEERABLE TRENCHER

(76) Inventors: Patrick Emmett Dean, 8028 Hill Trl N., Lake Elmo, MN (US) 55042; Katrina Alexis Faucett, 9040 520th St., Oak Creek, WI (US) 53154; Peter Jans Gillespie, 1435 Congress Ave., Oshkosh, WI (US) 54901; Parmanand Jagnandan, 3142 Longfellow Ave. S., Minneapolis, MN (US) 55402; Seongtae Kim, #221-1103, Munjung Family Apt., Munjung-Dong, Songpa-Gu, Seoul (KR) 138-767; Nick A Schottler, 1374 County Road I, Somerset, WI (US) 54025; Christopher Reginald Singh, 13892 Dublin Ct., Apple Valley, MN (US) 55124; Christopher Thomas Weyandt, 240 Maple St., Mahtomedi, MN (US) 55115

( * ) Notice: Subject to any disclaimer, the term of this patent is extended or adjusted under 35 U.S.C. 154(b) by 28 days.

(21) Appl. No.: 12/009,261

(22) Filed: Jan. 18, 2008

(65) Prior Publication Data

US 2009/0183396 A1 Jul. 23, 2009

(51) Int. Cl.
*E02F 5/00* (2006.01)

(52) U.S. Cl. ..... 37/348; 37/352; 172/3

(58) Field of Classification Search ..... 37/348, 37/414–416, 466, 234, 142.5, 347, 363, 352–362; 172/40–42, 155, 675, 158, 2–11
See application file for complete search history.

(56) References Cited

U.S. PATENT DOCUMENTS 4,103,441 A 8/1978 Flippin
4,195,427 A 4/1980 Lanham
4,322,899 A * 4/1982 Clune ..... 37/352
4,503,630 A 3/1985 Riley
4,896,442 A 1/1990 Stiff et al.
5,226,248 A 7/1993 Pollard
5,237,888 A * 8/1993 McCombs ..... 74/491
5,479,728 A * 1/1996 Deken et al. ..... 37/142.5
5,964,049 A 10/1999 Dean et al.
5,999,131 A 12/1999 Sullivan
6,061,617 A * 5/2000 Berger et al. ..... 701/50
6,651,361 B1 11/2003 Porter et al.
6,836,982 B1 * 1/2005 Augustine ..... 37/348
6,874,581 B1 4/2005 Porter et al.
6,883,616 B2 4/2005 Templeton
6,938,699 B2 9/2005 Templeton et al.
6,954,999 B1 10/2005 Richardson et al.
6,965,344 B1 11/2005 Halsey et al.
7,096,970 B1 8/2006 Porter et al.
7,139,662 B2 * 11/2006 Ericsson et al. ..... 701/207
2007/0131437 A1 6/2007 Sewell
2007/0132204 A1 6/2007 Sewell

* cited by examiner

*Primary Examiner*—Robert E Pezzuto

(57) ABSTRACT

A trencher has two wheels equidistant on either side of the arbor, and a third steerable wheel at the front of the trencher in line with the arbor. Speed of the arbor, forward motion of the trencher and the direction of motion are determined by motors controlled by an onboard control system. The onboard control system is controlled by a remote control, which may be a simple manual wireless controller or a programmable computer. With a programmable computer, the trencher can be pre-programmed to dig along a pre-selected path, e.g., a logo, flower or other design.

20 Claims, 4 Drawing Sheets

AUTOMATICALLY STEERABLE TRENCHER

TECHNICAL FIELD

The present invention relates to digging equipment, and in particular, to equipment for trenching.

BACKGROUND

Trenchers are used in landscaping to define beds, dig ditches for the bases of walls, allow insertion of edging or irrigation tubing and the like. Landscapers often use trenchers to provide the edging around basic, simple gardens, such as ovals or rectangles. While it has long been known to provide highly elaborate garden plans, such as the formal gardens at Versailles, using a trencher to create these shapes has not been practical because of the difficult of keeping a manually operated trencher precisely on course while digging in a complicated design. Instead, the design has been manually laid out and marked, e.g., with lime, then dug in by hand with a shovel. In addition to landscape uses, trenchers are used by electricians and utilities to install cables or wiring in small trenches in the ground.

Trenchers come in a variety of wheel configurations, including two wheel, three wheel and four wheel. Two wheel trenchers, such as those shown in U.S. Pat. Nos. 6,874,581 and 6,938,699 can be highly steerable in very tight curves, but depend entirely on manual brute force from the operator for steering. Four wheel trenchers such as those shown in U.S. Pat. Nos. 4,195,427 and 4,896,442 may reduce the amount of brute force required for steering, but the four wheel configuration prevents a very tight turning radius. Three wheel trenchers can have a tighter turning radius than four wheel trenchers, but most, such as those shown in shown in U.S. Pat. Nos. 4,503,630 and 5,226,248, are steered from the back. This means the wheels must be off-center from the trenching arbor, since they would fall into the trench of they were in-line with the arbor, and this in turn affects their stability, particularly in very tight turns.

The trencher shown in U.S. Pat. No. 5,964,049 (the first two figures of which are included herein as FIGS. 1 and 2) puts the steering wheel at the front of the trencher in line with the arbor, with the axis of the rear wheels in line with the arbor axis. This allows for a much tighter turning radius than the other designs, as well as stability during tight turns. However, the design as shown in the referenced patent has no drive to the wheels, so motive power still comes from the operator. In addition, the combination of the handle extending at the front of the trencher and the need for the operator to stand in front of the handle to pull the trencher limits the usefulness of the trencher in tight spaces.

SUMMARY OF THE INVENTION

The present invention improves upon these designs by providing a powered steering and drive mechanism and a control system for them. Preferably, the steering system is an electric motor mounted to a shaft extending upward from the pivot of the front wheel, and the drive mechanism is a hydraulic motor mounted to the front wheel. This configuration minimizes the total space required by the trencher, enabling its use in tight spaces.

The trencher also includes a control system to control the steering and drive mechanisms. This control system can take the form of a simple remote control with control knobs to allow an operator to manually regulate the power going to the different motors. Alternatively, this control system can incorporate a programmable computer, which can be programmed to steer the trencher along a specific path. In this configuration, the control system preferably is also provided with a position monitoring system to provide a feedback loop to the computer to ensure that the trencher is where expected.

A programmable trencher of such a design has the advantage that it can be used to cut shapes, such as logos, flowers, or any other design, into the earth. The pattern need not even be laid out and marked, just programmed into the computer. The computer then can use the position monitoring system to guide the trencher along the route needed for the design. The result is a trencher capable of doing types of digging that heretofore could only be done on a practical basis by hand.

BRIEF DESCRIPTION OF THE DRAWINGS

The following drawings are illustrative of particular embodiments of the present invention and therefore do not limit the scope of the invention. The drawings are not to scale (unless so stated) and are intended for use in conjunction with the explanations in the following detailed description. Embodiments of the present invention will hereinafter be described in conjunction with the appended drawings, wherein like numerals denote like elements.

DETAILED DESCRIPTION

The following detailed description is exemplary in nature and is not intended to limit the scope, applicability, or configuration of the invention in any way. Rather, the following description provides practical illustrations for implementing exemplary embodiments of the present invention. Those skilled in the art will recognize that many of the examples provided have suitable alternatives that can be utilized.

Figure 1:
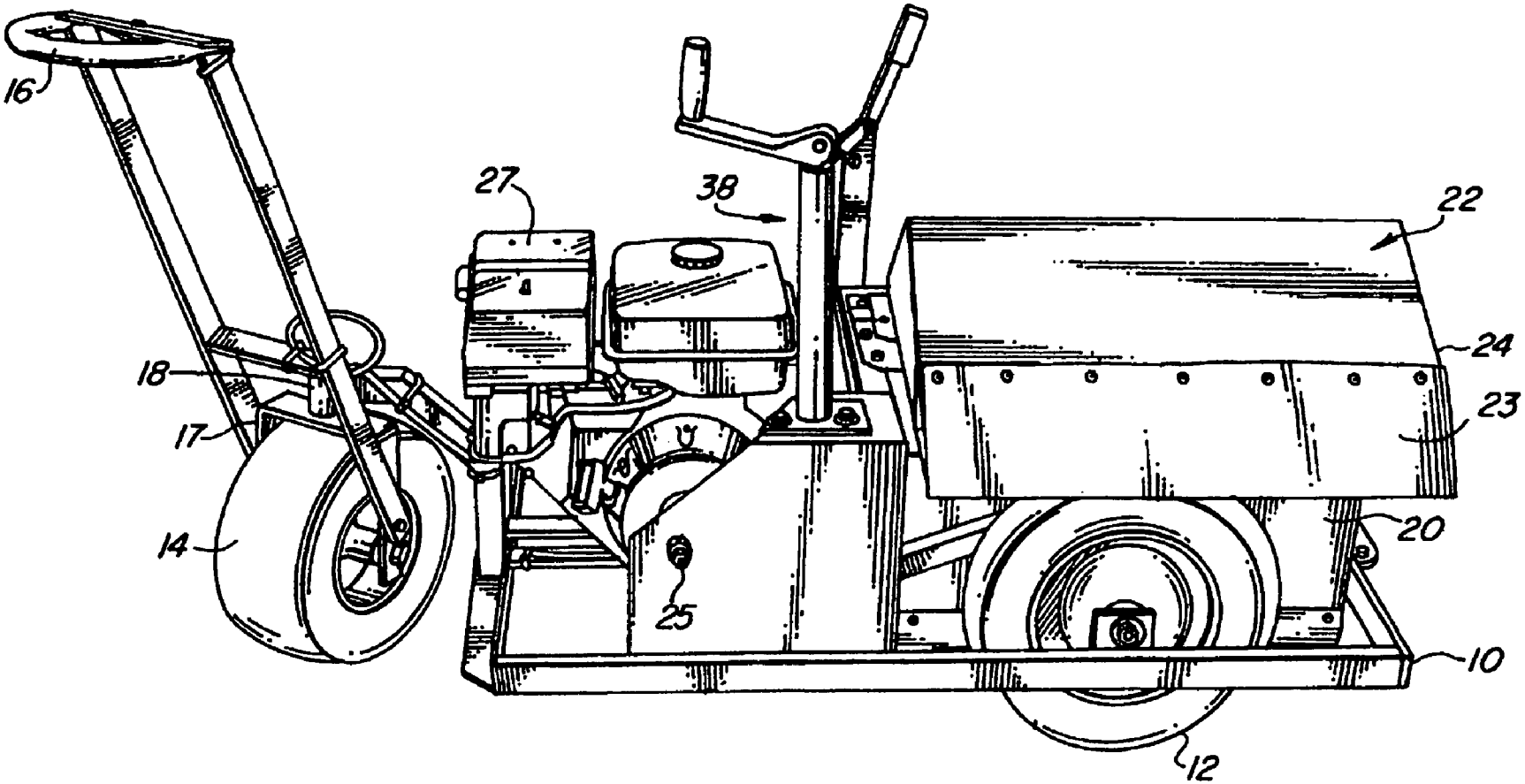
Fig. 1 (PRIOR ART)
FIG. 1 is a reproduction of FIG. 1 of U.S. Pat. No. 5,964,049, and is a perspective view of a trencher according to the prior art.
Figure 2:
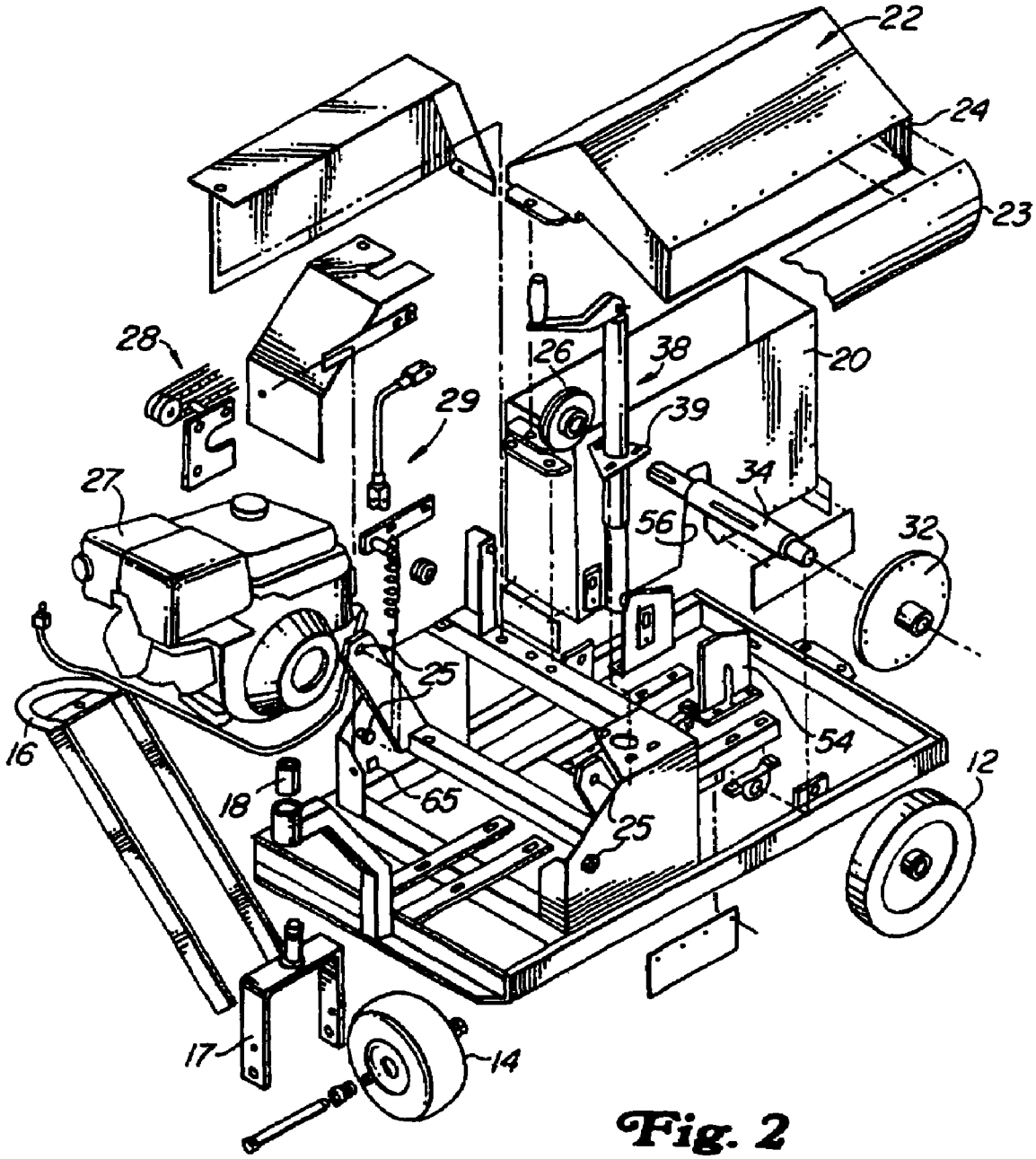
Fig. 2 (PRIOR ART)
FIG. 2 is a reproduction of FIG. 2 of U.S. Pat. No. 5,964,049, and is an exploded isometric view the trencher of FIG. 1 according to the prior art.

The prior art trencher shown in FIGS. 1 and 2 has a main frame 10 with two rear wheels 12 rotatably mounted thereto (only the foreground wheel is visible for clarity of illustration). A front wheel 14 and steering handle 16 are mounted to a front wheel bracket 17, which is in turn rotatably mounted to the main frame 10 via bushing 18. The bushing 18 is located along the longitudinal center line of the main frame 10, so that the rear wheels 12 and front wheel 14 form a balanced tripod arrangement which is readily steerable by changing the direction of the steering handle 16.

An arbor housing 20 is mounted on the main frame 10 towards the rear thereof and centered between the rear wheels 12. A deflector housing 22 is removably attached to the top of the arbor housing 20, and preferably is reversible to deflect dirt in either direction. A rubber flap 23 or the like preferably is provided on the discharge chute 24 of the deflector housing 22 to prevent objects from being thrown.

An arbor pivot bracket 30 is pivotally mounted to the main frame 10 at pivot points 25, e.g., by the use of bolts or pins. An arbor 32 is fixedly mounted to a shaft 34 which is rotatably mounted to the arbor pivot frame 30. A pulley 26 is fixed to the shaft 34. An engine 27 is mounted to the main frame 10, and drives the shaft 34 and arbor 32 through a belt drive 28 and clutch 29 to the pulley 26 in the usual manner.

Figure 3:
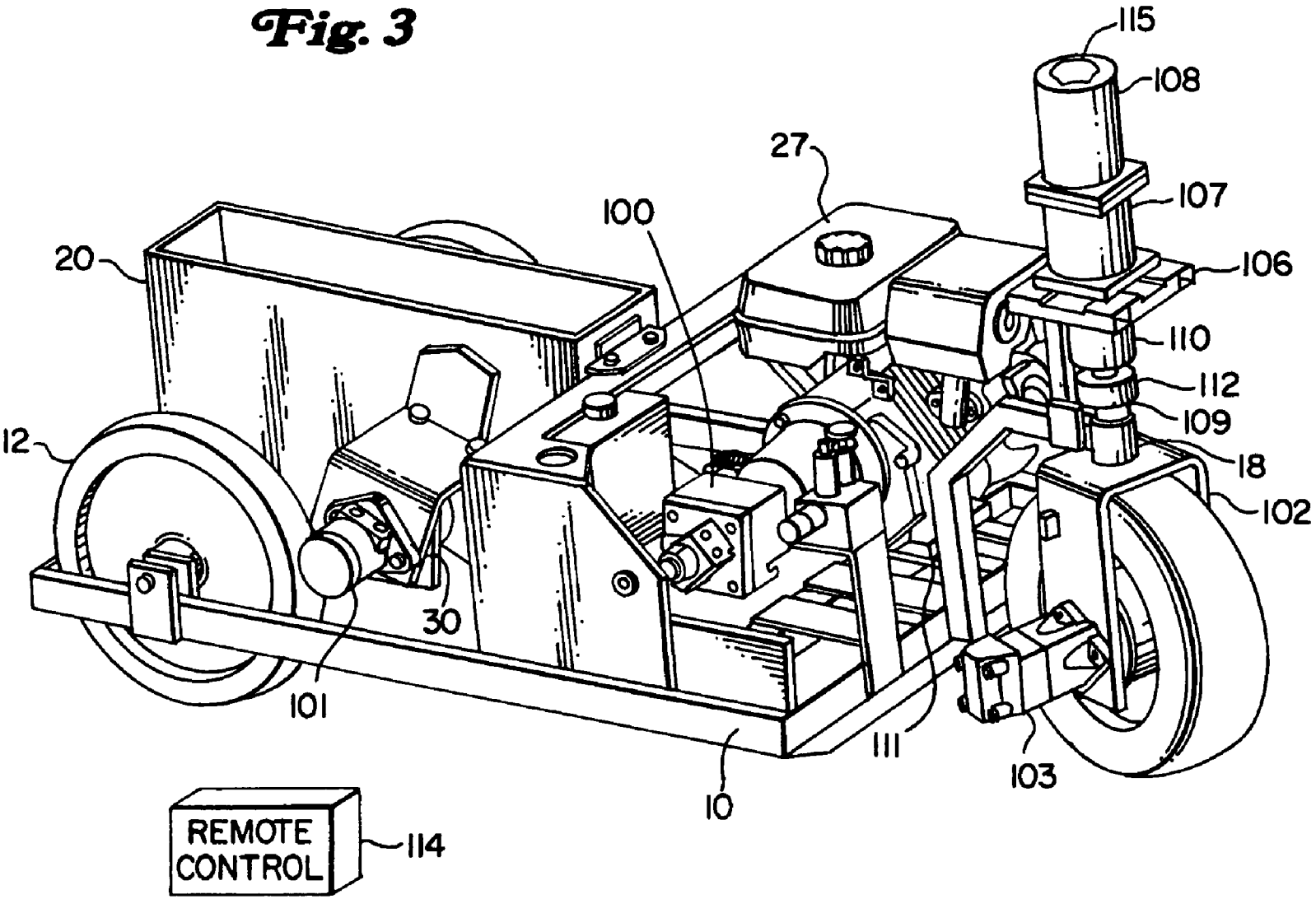
FIG. 3 is a side perspective view of the main components of a preferred embodiment of a trencher according to the present invention.
Figure 4:
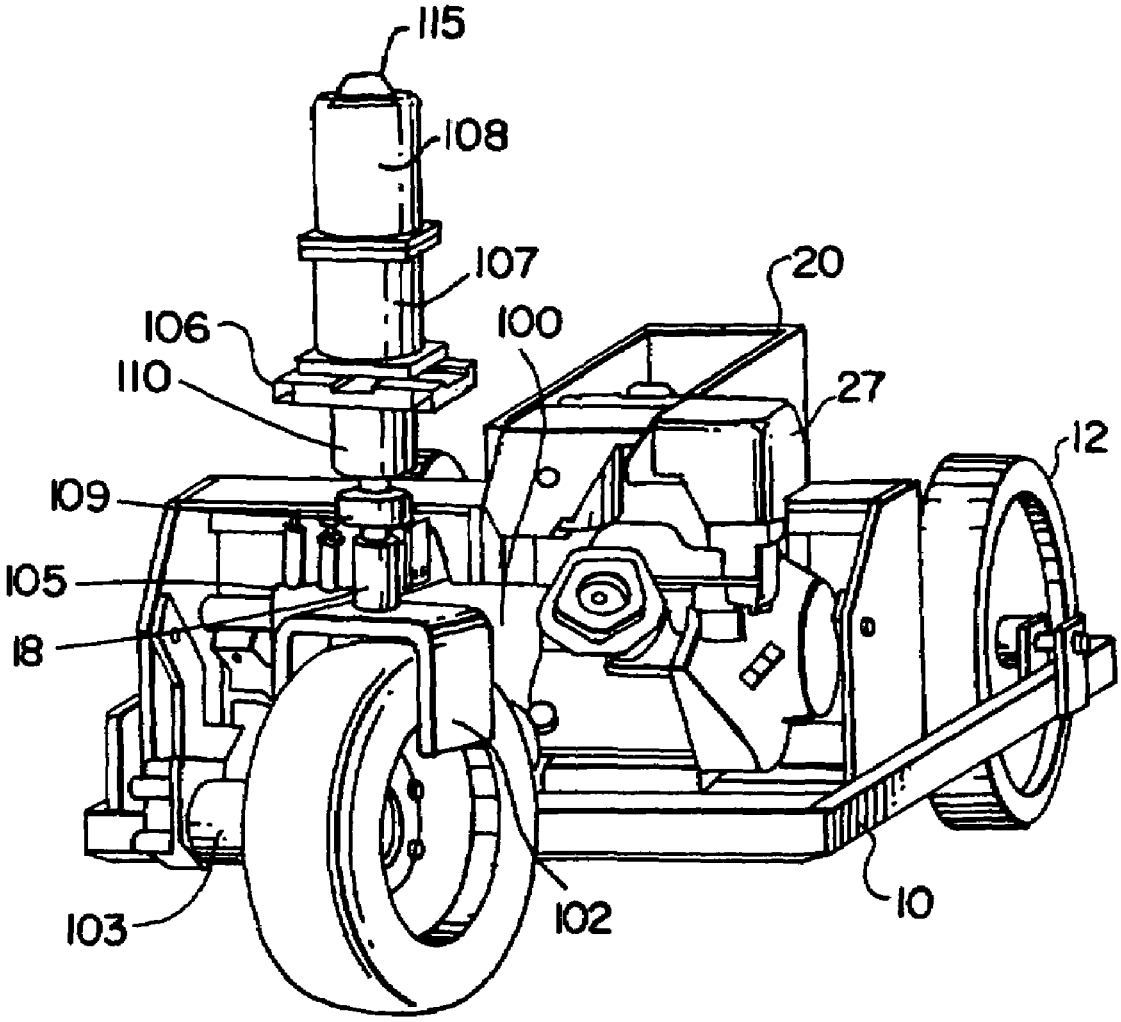
FIG. 4 is a front perspective view of the preferred embodiment of FIG. 3.

FIGS. 3 and 4 illustrate a preferred embodiment of improving upon this design according to the present invention. In FIGS. 3 and 4, parts which are essentially the same as in the prior design, e.g., rear wheel 12, use the same reference numbers as in FIGS. 1 and 2. Many of the parts illustrated in U.S. Pat. No. 5,964,049, e.g., the deflector housing 22, have been omitted in FIGS. 3 and 4 for clarity of illustration, but it will be understood that they are still included in the complete embodiment. Reference may be had to U.S. Pat. No. 5,964,049 for details of those components.

Turning to FIGS. 3 and 4, a hydraulic pump 100 is mounted to be driven by engine 27. A hydraulic motor 101 is mounted to the arbor pivot frame 30 and connected to drive the arbor through shaft 34. The front wheel 14 is pivotally mounted in the bushing 18 by a front wheel bracket 102. Another hydraulic motor 103 is mounted to the front wheel bracket 102 and connected to drive the front wheel 14. A hydraulic valve box 105 is mounted to the main frame and connected via conventional hydraulic tubing (not shown for clarity of illustration) between the hydraulic pump 100, and the hydraulic motors 101, 103.

A mounting frame 106 is mounted to the main frame 10 in a position above the front wheel bushing 18. A gear reducer 107 is mounted to the top of the mounting frame 106, with an output shaft extending downward through the mounting frame 106. An electric motor 108 is mounted to the top of the gear reducer 107, with the shaft of the electric motor connected as the input to the gear reducer 107. The front wheel bracket 102 includes a shaft 109 which extends upwardly beyond the bushing 18. The output shaft of the gear reducer 107 engages the upwardly extending shaft 109 via a keyway 110.

An onboard control system 111 is mounted in any suitable location and is connected via wires (not shown for clarity of illustration) to control the electric steering motor 108 and the hydraulic valve box 105, which in turn controls flow to the hydraulic motors 101, 103. A potentiometer 112 is mounted below the keyway 110 to monitor the rotational position of the upwardly extending shaft 109, and therefore of the front wheel 14, and provide a signal representative thereof to the onboard control system 111 via a wire (not shown for clarity of illustration).

In this configuration, the onboard control system 111 can control the rotational speed of the arbor by controlling the output of the hydraulic motor 101 and the longitudinal motion of the trencher by controlling the output of the hydraulic motor 103. Preferably, the hydraulic valve box 105 includes separate valves for each of the hydraulic motors 101, 103, so that the onboard control system 111 can independently control the arbor speed and the speed at which the trencher moves. In addition, the hydraulic valve box 105 preferably includes valves to allow the drive motor to be driven both in forward and reverse. The onboard control system 111 can control the steering of the trencher by controlling the electric motor 108, using the output of the potentiometer to provide a feedback loop.

The onboard control system 111 preferably is itself controlled by a remote control 114, which may be in communication by wire to the onboard control system 111, but preferably communicates wirelessly. The remote control 114 can be a simple hand operated radio control, much like those used with a radio controlled toy car, with knobs or other controls to adjust the arbor speed, drive speed and steering direction.

Preferably, the remote control 114 is a programmable computer. The computer can be programmed to emulate the simple hand operated radio control for use in manually guided use of the trencher, but also can be pre-programmed to drive the trencher along a pre-selected path. To assist in this configuration, a position sensor 115 may be provided on the trencher which can determine the position of the trencher at any time. A global positioning system such as that shown in U.S. Pat. No. 6,954,999 would be sufficient for this purpose in some situations, but in most situation a more precise localized laser, optical or radio frequency triangulation position will be preferable, e.g., systems such as those shown in U.S. Pat. Nos. 5,999,131 and 6,965,344. The position information from the position sensor 115 then can be provided to the remote control 114 to use as feedback to ensure that the trencher is following the appropriate path and adjust the steering and motion appropriately to keep it on path.

All patents referenced herein are incorporated by reference.

In the foregoing detailed description, the invention has been described with reference to specific embodiments, but various changes thereto will be readily apparent to one of ordinary skill in the art. For example, while specific types of motors have been described in particular locations, it will be understood that electric, hydraulic, pneumatic or other motors could be substituted for all of them, with corresponding changes to the onboard control system. Similarly the hydraulic motor 103 could be mounted to one of the rear wheels 12 instead of the front wheel 14. It may be appreciated that various other modifications and changes can be made without departing from the scope of the invention as set forth in the appended claims.

The invention claimed is:

1. A trencher for digging trenches in the earth comprising:

a) a main frame;

b) an arbor support frame mounted to the main frame;

c) an arbor rotatably mounted to the arbor support frame;

d) two rear wheels, each rotatably and co-axially mounted to the main frame, and wherein the arbor is between the rear wheels along their shared axis; and e) a front wheel mounted to a front wheel bracket having an upwardly extending shaft which is pivotally mounted to the main frame in front of and substantially in line with the arbor;

f) a steering motor connected to the main frame above the front wheel and connected to the upwardly extending shaft of the front wheel bracket to selectively change the orientation of the front wheel relative to the main frame to steer the trencher;

g) a drive motor connected to drive at least one of the wheels in at least one direction; and h) a control system for controlling the steering motor to steer the trencher and the drive motor to move the trencher.

2. The trencher of claim 1, further comprising a gear reducer connected to the upwardly extending shaft, and wherein the steering motor steers the front wheel through the gear reducer.

3. The trencher of claim 1, further comprising a sensor to generate a signal representative of the rotational orientation of the front wheel and provide such signal to the control system.

4. The trencher of claim 3, wherein the control system adjusts the steering motor in a closed feedback loop based on the rotational orientation signal from the sensor.

5. The trencher of claim 3, wherein the sensor comprises a potentiometer positioned to measure the rotational orientation of the upwardly extending shaft.

6. The trencher of claim 1, wherein the drive motor selectively can drive the at least one wheel both forward and backward.

7. The trencher of claim 6, wherein the control system can control the drive motor to move the trencher forward or backward.

8. The trencher of claim 1, wherein the drive motor drives the front wheel.

9. The trencher of claim 1, further comprising an arbor motor mounted to the arbor support frame and connected to drive the arbor.

10. The trencher of claim 9, wherein the control system further controls the arbor motor to control the speed of rotation of the arbor.

11. The trencher of claim 10, wherein the control system can control the arbor motor speed independently of the drive motor speed.

12. The trencher of claim 9, wherein the arbor motor, the drive motor and the steering motor are selected from the group consisting of electric motors, hydraulic motors and pneumatic motors.

13. The trencher of claim 1, wherein the system further comprises a remote control in active communication with the control system and the control system further comprises a remote control receiver for receiving instructions from the remote control to control the arbor motor speed, drive motor direction and speed, and steering angle.

14. The trencher of claim 11, wherein the remote control further comprises a computer which is programmable to send instructions to the control system to direct the motion of the trencher.

15. The trencher of claim 14, further comprising a positioning system to generate a signal representative of the position of the trencher and provide such signal to the remote control.

16. The trencher of claim 15, wherein the computer uses a closed feedback loop based on the position signal to direct the trencher to dig a trench along a specific path.

17. The trencher of claim 16, wherein the specific path comprises a logo or other pre-determined design.

18. A trencher for digging trenches in the earth comprising:

a) a main frame;

b) an arbor support frame mounted to the main frame;

c) an arbor rotatably mounted to the arbor support frame;

d) an arbor drive motor mounted to the arbor support frame and connected to drive the arbor;

e) two rear wheels, each rotatably and co-axially mounted to the main frame, and wherein the arbor is between the rear wheels along their shared axis; and f) a front wheel mounted to a front wheel bracket having an upwardly extending shaft which is pivotally mounted to the main frame in front of and substantially in line with the arbor;

g) a steering motor connected to the main frame above the front wheel and connected to the upwardly extending shaft of the front wheel bracket to selectively change the orientation of the front wheel relative to the main frame to steer the trencher;

h) a drive motor mounted to the front wheel bracket and connected to drive the front wheel; and i) a control system for controlling the steering motor to steer the trencher, the drive motor to move the trencher and the arbor motor to turn the arbor.

19. The trencher of claim 18, further comprising a programmable remote control in wireless communication with the control system for instructing the control system how to steer and move the trencher and turn the arbor.

20. A trencher for digging trenches in the earth comprising:

a) a main frame;

b) an arbor support frame mounted to the main frame;

c) an arbor rotatably mounted to the arbor support frame;

d) an arbor drive motor mounted to the arbor support frame and connected to drive the arbor;

e) two rear wheels, each rotatably and co-axially mounted to the main frame, and wherein the arbor is between the rear wheels along their shared axis; and f) a front wheel mounted to a front wheel bracket which is pivotally mounted to the main frame in front of and substantially in line with the arbor;

g) a steering motor connected to the main frame and the front wheel bracket to selectively change the orientation of the front wheel relative to the main frame to steer the trencher;

h) a drive motor mounted to the front wheel bracket and connected to drive the front wheel; and i) a control system for controlling the steering motor to steer the trencher, the drive motor to move the trencher and the arbor motor to turn the arbor, the control system comprising:

i) a positioning system to generate a signal representative of the position of the trencher;

ii) an on-board portion for receiving and implementing instructions to adjust the arbor motor speed, drive motor direction and speed, and steering angle; and iii) a remote control portion having a computer programmable to receive and use the signal representative of the position of the trencher in a closed feedback loop to send instructions to the on-board portion to direct the trencher to dig a trench along a specific path.

* * * * *